US009074574B2

(12) United States Patent
Hammer et al.

(10) Patent No.: US 9,074,574 B2
(45) Date of Patent: Jul. 7, 2015

(54) GLOW PLUG AND METHOD FOR PRODUCING A GLOW PENCIL

(71) Applicant: BorgWarner BERU Systems GmbH, Ludwigsburg (DE)

(72) Inventors: Jochen Hammer, Stuttgart (DE); Michael Eberhardt, Neckargemuend (DE); Johannes Hasenkamp, Ludwigsburg (DE); Stefan Knoll, Oelbronn (DE); Markus Schittkowski, Ludwigsburg (DE); Martin Allgaier, Ludwigsburg (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 271 days.

(21) Appl. No.: 13/673,709

(22) Filed: Nov. 9, 2012

(65) Prior Publication Data

US 2013/0118432 A1 May 16, 2013

(30) Foreign Application Priority Data

Nov. 11, 2011 (DE) ..... 10 2011 055 283

(51) Int. Cl.

| | |
|---|---|
| ***F02P 19/02*** | (2006.01) |
| ***F23Q 7/00*** | (2006.01) |
| *F02N 19/04* | (2010.01) |

(52) U.S. Cl.

CPC ..... *F02P 19/02* (2013.01); *F02P 19/026* (2013.01); *F02N 19/04* (2013.01); *F23Q 7/001* (2013.01)

(58) Field of Classification Search

CPC ..... F02P 19/02; F02P 19/026; F02N 19/04; F23Q 7/001

USPC ..... 123/179.21, 179.6, 169 R, 143 B, 143 C, 123/145 A

See application file for complete search history.

(56) References Cited

U.S. PATENT DOCUMENTS

| | | | | |
|---|---|---|---|---|
| 4,418,661 | A | 12/1983 | Esper et al. | |
| 4,426,568 | A | 1/1984 | Kato et al. | |
| 5,750,958 | A | 5/1998 | Okuda et al. | |
| 5,880,432 | A * | 3/1999 | Radmacher | 219/270 |
| 6,084,212 | A | 7/2000 | Leigh | |
| 6,335,516 | B1 | 1/2002 | Müller et al. | |
| 6,610,964 | B2 | 8/2003 | Radmacher | |
| 6,817,754 | B2 | 11/2004 | Tsang et al. | |
| 7,160,584 | B2 | 1/2007 | Goeb et al. | |
| 7,483,138 | B2 | 1/2009 | Sahiri et al. | |
| 7,607,206 | B2 | 10/2009 | Walker, Jr. et al. | |
| 7,688,429 | B2 | 3/2010 | Sahari et al. | |

(Continued)

FOREIGN PATENT DOCUMENTS

| | | | |
|---|---|---|---|
| DE | 202 937 | | 10/1983 |
| DE | 33 18 458 | A1 | 11/1984 |
| DE | 38 43 863 | A1 | 6/1990 |
| DE | 44 33 505 | A1 | 3/1995 |
| DE | 199 30 334 | A1 | 11/2001 |
| DE | 102 22 785 | A1 | 12/2003 |
| DE | 600 12 053 | T2 | 5/2005 |
| DE | 10 2004 023 178 | A1 | 12/2005 |
| DE | 10 2004 039 564 | A1 | 3/2006 |
| DE | 103 53 972 | B4 | 3/2006 |
| DE | 10 2005 036 898 | A1 | 2/2007 |
| EP | 1 536 180 | A1 | 1/2004 |

*Primary Examiner* — Mahmoud Gimie

(74) *Attorney, Agent, or Firm* — Bose McKinney & Evans LLP

(57) ABSTRACT

The invention relates to a glow plug for a diesel engine, said glow plug comprising a ceramic glow pencil, which has a heating portion, and a housing, from which the glow pencil protrudes, wherein the glow pencil has a ceramic inner conductor, an insulation layer surrounding the inner conductor, and a ceramic outer conductor layer arranged on the insulation layer. In accordance with this disclosure, the outer conductor layer in the heating portion only partially covers the insulation layer.

7 Claims, 4 Drawing Sheets

(56) References Cited

U.S. PATENT DOCUMENTS

2002/0153365 A1* 10/2002 Taniguchi et al. ..... 219/270
2002/0185485 A1* 12/2002 Radmacher ..... 219/270
2005/0118346 A1 6/2005 Goeb et al.
2007/0151096 A1 7/2007 Walker, Jr. et al.
2008/0253933 A1 10/2008 Redfern

* cited by examiner

GLOW PLUG AND METHOD FOR PRODUCING A GLOW PENCIL

RELATED APPLICATIONS

This application claims priority to DE 10 2011 055 283.9, filed Nov. 11, 2011 which is hereby incorporated by reference in its entirety.

BACKGROUND

The invention relates to a glow plug. Glow pencils for such glow plugs can be produced by first creating a green body by extrusion that has a core made of ceramic material that is electrically conductive after sintering, an intermediate layer that surrounds the core and is made of ceramic material that is electrically insulating after sintering, and a layer that surrounds the intermediate layer and is made of ceramic material that is electrically conductive after sintering. Once the green body has been sintered, the outer layer forms the outer conductor of the glow pencil and the core forms the inner conductor of the glow pencil. In order to provide the glow pencil with a heating portion, the outer layer is removed from an end portion of the green body before sintering and this end portion is enclosed by a layer made of another ceramic material that is electrically conductive after sintering. This layer can be applied as slip and may be called a slip layer. By sintering the green body, an outer conductor layer having increased electrical resistance, that is to say, a heating layer, is formed from the slip layer.

Such glow pencils are sometimes referred to as outwardly heating glow pencils, since the heating resistor is provided as a portion of the outer conductor. This has advantages compared to inwardly heating glow pencils, in which a portion of the inner conductor is provided as a heating resistor. More specifically, in outwardly heating glow pencils the heat generated in the heating resistor can be emitted very quickly and efficiently to a fuel/air mixture in the combustion chamber of an engine.

The surface temperature of outwardly heating glow pencils responds very quickly to a change in the heating power, and therefore outwardly heating glow plugs can be controlled using modern glow plug control devices in accordance with the power stroke of an internal combustion engine. Modern glow plugs and glow plug control devices can thus assist fuel combustion efficiently and can adapt the heating process to individual requirements of a motor, for example, so as to increase the performance thereof or to reduce the exhaust emissions thereof.

SUMMARY

The present invention better satisfies demands placed on an engine in terms of optimal assistance of fuel combustion.

In a glow plug according to this disclosure the outer conductor layer covers only a part of the insulation layer in the heating portion. A first part of the area of the insulation layer in the heating portion is thus free from the outer conductor layer, whereas a second part of the area of the insulation layer is covered by the outer conductor layer. As a result of the ratio of these two areas, the electrical resistance of a glow plug can be adapted to the requirements of a given type of engine or vehicle.

A precisely defined outer conductor layer, which leaves partial areas of the insulation layer uncovered, can be produced by printing onto a green body a layer made of ceramic material that is electrically conductive after sintering. Jet printing methods are particularly well suited. Pad printing methods are also possible, for example.

The electrical resistance of a glow pencil according to these teachings can be set to a desired value by printing suitably formed heating conductor portions on the insulating layer of a green body. This can be done at low cost. A glow plug that is adapted to the requirements of a given type of engine or to a given purpose can thus be produced cost effectively by a production method according to this disclosure.

The outer conductor layer in the heating portion may be strip shaped, i.e. cover one or more strip-shaped areas of the insulation layer, and leave free partial areas of the insulation layer between adjacent portions of the heat conductor layer. It is possible that the outer conductor layer forms only a single track in the heating portion, for example a helically wound track. The electrical resistance is in this case determined by the length and width of this track. The outer conductor layer in the heating portion may also form a plurality of tracks, however, which are each arranged at a distance from one another. In the simplest case, these tracks may run in a straight line in the longitudinal direction of the glow pencil or may have a complicated form, for example, they may be wound in a meandering manner or curved helically.

In accordance with an advantageous refinement, the outer conductor layer in the heating portion is covered by a protective layer. With such a protective layer it is possible to increase the service life of a glow plug. Since the outer conductor layer of a glow plug according to this disclosure only partially covers the insulation layer in the heating portion, the outer conductor layer usually forms steps, which are pronounced to a greater or lesser extent. When handling the glow plug, for example, when installing it in an engine, there is therefore a risk that the glow plugs may become caught on obstacles as a result of these steps and that part of the outer conductor layer may therefore become chipped or damaged. Due to an electrically insulating protective layer, the outer conductor layer can be protected effectively against damage. In particular, such a protective layer can also compensate for differences in height between covered and uncovered portions of the insulation layer.

By printing the layer that forms the outer conductor layer in the heating portion once the green body has been sintered, the layer thickness can be predefined within narrow manufacturing tolerances. The electrical resistances of glow pencils produced in accordance with this disclosure therefore vary only to a small extent, which considerably facilitates actuation of the glow plugs at a desired target temperature. The layer is preferably printed on in a thickness of less than 50 μm, preferably less than 30 μm. The layer thickness generally decreases slightly during sintering. The outer conductor layer in the heating portion of the glow pencil in the heating portion of a glow pencil according to these teachings preferably has a thickness of less than 50 μm, preferably of less than 30 μm.

As already mentioned, the outer conductor layer of the heating portion can be printed by means of a jet printing process. Continuous jet methods, which are often referred to in the literature as "continuous ink jet" methods are particularly well suited. In these printing methods, the liquid to be printed, which is normally referred to as ink, runs continuously through the print head, irrespective of whether or not printing is currently carried out. Depending on the image to be printed, some of the liquid from the continuous flow is diverted for printing onto a surface on which the image is to be printed, that is to say the part of the ink that is to reach the surface is electronically controlled. The liquid flow or the drops is/are charged by means of a charging electrode. As a result of this charging process, the liquid can then be diverted in the electric field of a baffle and the printing process can thus be controlled. If, with this method, no printing is to be carried out soon, the liquid jet is not diverted onto the surface to be printed. The liquid can then be collected again via a collector pipe and fed back into a storage container. Other jet printing methods, which are likewise compatible with this disclosure, are known in conjunction with ink jet printing as bubble jet printing, drop on demand printing, and Piezo printing.

BRIEF DESCRIPTION OF THE DRAWINGS

Further details and advantages of the invention will be explained by illustrative embodiments with reference to the accompanying drawings. Like and corresponding components are denoted by corresponding reference numbers. In the drawings.

DETAILED DESCRIPTION

Figure 1:
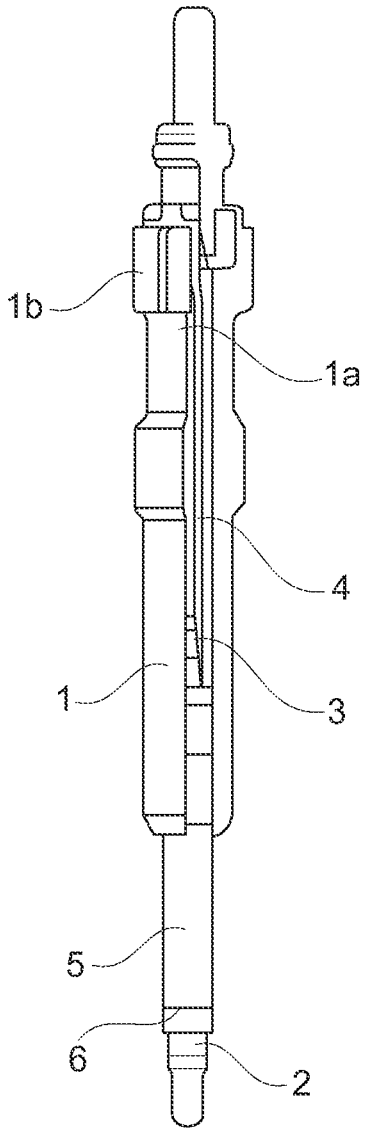
FIG. 1 shows a schematic illustration of a glow plug.

FIG. 1 shows a schematic illustration of a glow plug in a partly cut-away view. The illustrated glow plug has a housing 1, from which a ceramic glow pencil 2 protrudes. In the illustrated embodiment, the housing 1 has an outer thread 1*a* and a hexagon head 1*b* for screwing into an engine. Glow plugs can also be mounted on an engine in a different manner, however, and therefore other fastening means may be provided instead of the outer thread 1*a* and the hexagon head 1*b*.

The glow pencil 2 may have a tapered portion at its end arranged in the housing 1, said tapered portion fitting in a connection element 3, via which the glow pencil is connected to an internal pole 4 of the glow plug. At its other end, the glow pencil 2 has a heating portion, which is preferably thinner than a main portion connecting thereto. The heating portion may be cylindrical or tapering, especially conically tapering. Between its two end portions, the glow pencil may be surrounded by a protective sleeve 5.

Figure 2:
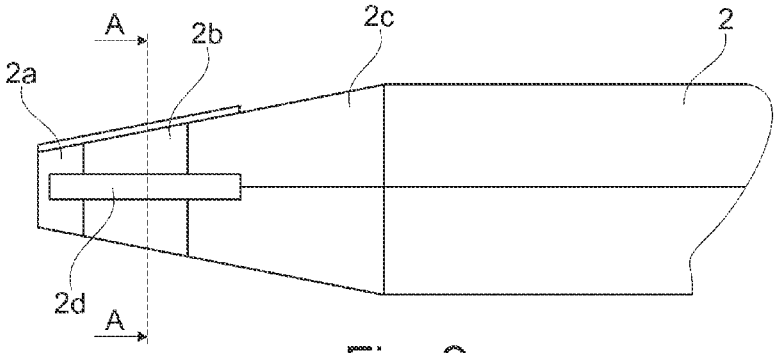
FIG. 2 shows a schematic illustration of a glow pencil.

FIG. 2 shows a schematic illustration of an embodiment of a glow pencil 2. This glow pencil 2 has a glow tip with a tapering heating portion. The heating portion may connect directly to a cylindrical main portion. It is also possible for an intermediate portion to be located between the heating portion and the main portion. The glow pencil 2 comprises a ceramic inner conductor 2*a*, a ceramic insulation layer 2*b* surrounding the inner conductor 2*a*, and an outer conductor layer 2*c* arranged on the insulation layer 2*b*. The outer conductor layer 2*c* is removed in the heating portion, for example by turning.

In the illustrated embodiment, the glow pencil 2 tapers to such an extent that the inner conductor 2*a* is exposed at its end. The heating portion may taper conically. The heating portion may also be cylindrical, for example.

In the heating portion, the insulation layer 2*b* is partially covered by an outer conductor layer 2*d*, which forms a heat conductor. In the illustrated embodiment, the outer conductor layer 2*d* in the heating portion covers a plurality of strip-like areas of the insulation area 2*b* and leaves free partial areas of the insulation layer 2*b* between adjacent partial areas of the outer conductor layer 2*d*. The covered partial areas of the outer conductor layer 2*d* form a plurality of tracks, which electrically connect the inner conductor 2*a* to the outer conductor layer 2*c*, which completely covers the insulation layer in the main portion of the glow pencil 2. The outer conductor layer 2*d* should have a thickness of no more than 100 μm, better of no more than 50 μm, and in particular of no more than 30 μm.

The outer conductor layer 2*d* printed onto the insulation layer in the heating portion is thinner than the outer conductor layer 2*c* in the cylindrical main portion of the glow pencil 1.

Figure 3:
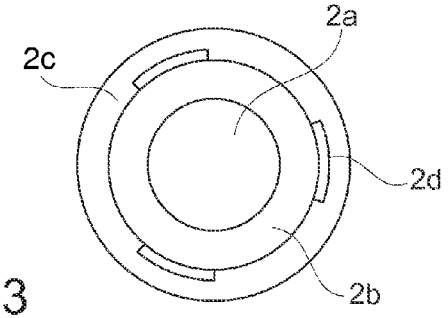
FIG. 3 shows a sectional view of FIG. 2.
Figure 4:
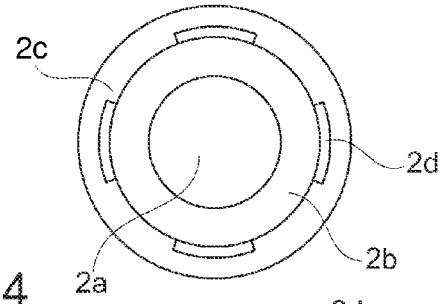
FIG. 4 shows a sectional view of a further embodiment.
Figure 5:
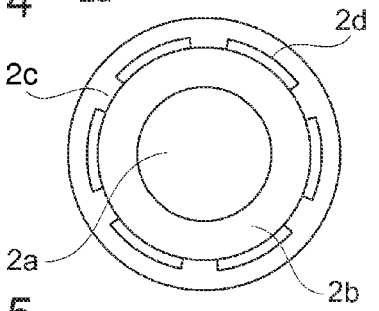
FIG. 5 shows a sectional view of a further embodiment.

FIG. 3 shows a sectional view along the line of section AA of FIG. 2. The electrical resistance of the heating portion can be set to a desired value by the number and design of the individual tracks. FIGS. 4 and 5 show a schematic illustration of sectional views of other embodiments of a glow pencil 2. These embodiments differ from the embodiment of FIGS. 2 and 3 only in the number and width of the tracks.

Figure 6:
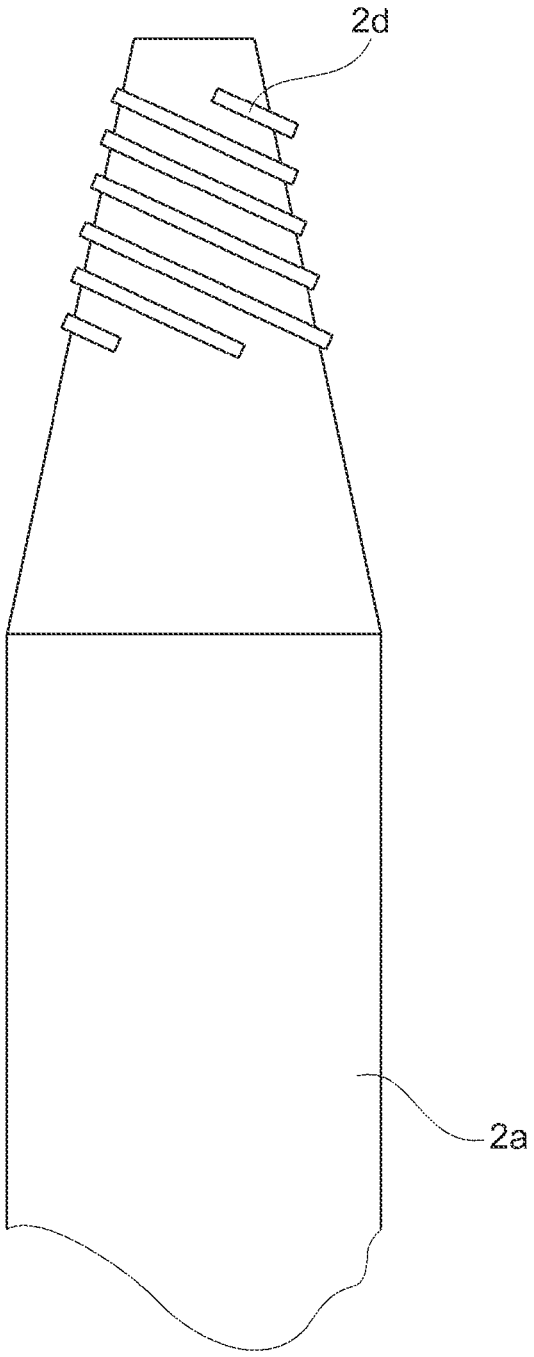
FIG. 6 shows a schematic illustration of a further embodiment.
Figure 7:
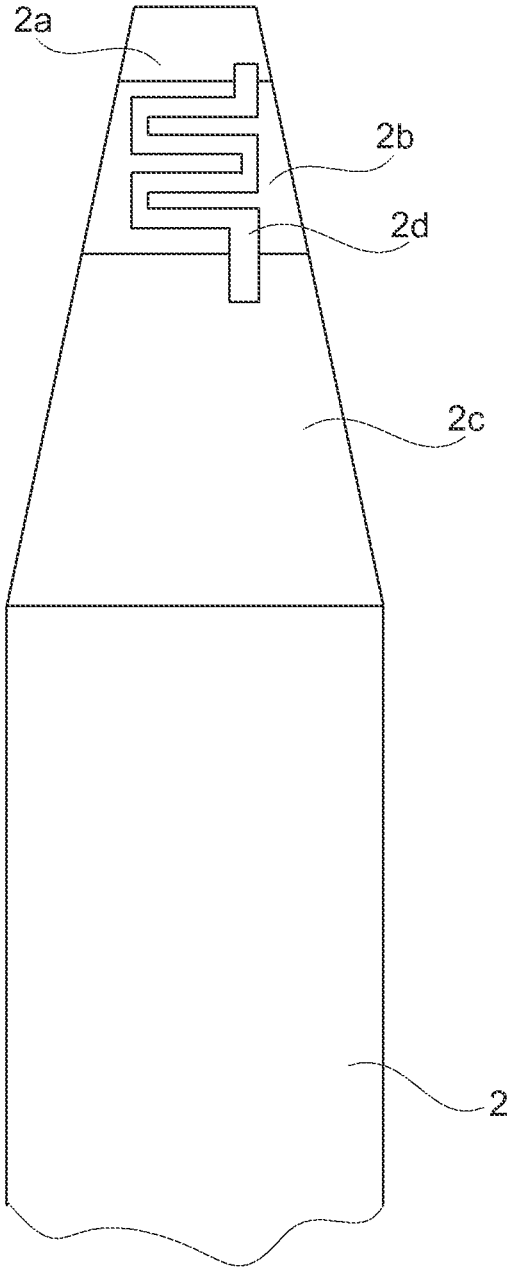
FIG. 7 shows a schematic illustration of a further embodiment.

Instead of forming the tracks as strips, which run in the longitudinal direction of the glow pencil 2, the outer conductor 2*d* may also cover one or more strip-like areas of the insulation layer 2*c*, which are wound around the heating portion. FIG. 6 shows an embodiment in which the outer conductor layer 2*d* in the heating portion has helically wound tracks. FIG. 7 shows a further embodiment of a glow pencil 2, in which the outer conductor layer in the heating portion is formed by one or more tracks wound in a meandering manner. Other configurations are possible and are contemplated by these teachings.

The outer conductor layer can be covered in the heating portion in each of the described embodiments by a protective layer. It is also possible to dispense with an electrically insulating protective layer.

The above-described glow pencils 2 can be produced by first producing a green body by coextrusion, said green body having a core made of ceramic material that is electrically conductive after sintering, an intermediate layer that surrounds the core and is made of ceramic material that is electrically insulating after sintering, and a layer that surrounds the intermediate layer and is made of ceramic material that is electrically conductive after sintering. For example, the ceramic materials may be produced on the basis of aluminium oxide or silicon nitride and made conductive by additions of molybdenum silicide or other conductive ceramic materials. The layer made of ceramic material that is electrically conductive after sintering is removed from an end portion of the green body. Another layer made of ceramic material that is electrically conductive after sintering is then printed onto the end portion, for example by means of a jet printing method. The green body is then sintered.

The layer can be printed onto the end portion of the green body in a thickness of less than 50 μm, preferably of less than 30 μm.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

REFERENCE NUMBERS

1 housing
1*a* outer thread
1*b* hexagon head
2 glow pencil
2*a* inner conductor
2*b* insulation layer
2*c* outer conductor layer in cylindrical main portion
2*d* outer conductor layer in the heating portion
2*e* protective layer
3 connection element
4 internal pole
5 protective sleeve

What is claimed is:

1. A glow plug for a diesel engine, said glow plug comprising:

a ceramic glow pencil having a heating portion; and a housing from which the glow pencil protrudes;

wherein the glow pencil has a ceramic inner conductor, an insulation layer surrounding the inner conductor, and a ceramic outer conductor layer arranged on the insulation layer; and wherein the outer conductor layer only partially covers the insulation layer in the heating portion, further wherein the outer conductor layer in the heating portion covers one or more areas of the insulation layer and leaves free areas of the insulation layer between adjacent portions of the outer conductor layer, whereby the electrical resistance of the heating portion is a function of the ratio of the covered to free areas of the insulation layer.

2. The glow plug according to claim 1, wherein the one or more covered areas comprise strips.

3. The glow plug according to claim 1, wherein the outer conductor layer in the heating portion forms a plurality of tracks.

4. The glow plug according to claim 1, wherein the outer conductor layer in the heating portion is covered by a protective layer.

5. The glow plug according to claim 1, wherein the heating portion is thinner than a main portion of the glow plug.

6. The glow plug according to claim 1, wherein the outer conductor layer fully covers the insulation layer in a main portion of the glow pencil.

7. The glow plug according to claim 1, wherein the heating portion tapers and at a tapered end thereof, the insulation layer is removed and the outer conductor layer is arranged on the inner conductor.

* * * * *